United States Patent [19]

Ruf

[11] 4,222,715

[45] Sep. 16, 1980

[54] DEVICE FOR DELIVERY CONTROL IN A ROTARY PISTON COMPRESSOR

[75] Inventor: Max Ruf, Obereisesheim, Fed. Rep. of Germany

[73] Assignee: Audi NSU Auto Union Aktiengesellschaft, Fed. Rep. of Germany

[21] Appl. No.: 12,760

[22] Filed: Feb. 16, 1979

[30] Foreign Application Priority Data

Feb. 21, 1978 [DE] Fed. Rep. of Germany ..... 2807301

[51] Int. Cl.[3] ..... F04B 49/00

[52] U.S. Cl. ..... 417/310

[58] Field of Search ..... 417/310, 282; 418/71

[56] References Cited

U.S. PATENT DOCUMENTS

| | | | |
|---|---|---|---|
| 3,600,108 | 8/1971 | Tomita | 417/284 |
| 4,060,343 | 11/1977 | Newton | 417/310 |
| 4,068,981 | 1/1978 | Mandy | 417/310 |
| 4,074,957 | 2/1978 | Clarke | 417/310 |

*Primary Examiner*—Robert W. Jenkins

*Attorney, Agent, or Firm*—Kane, Dalsimer, Kane, Sullivan and Kurucz

[57] ABSTRACT

A device for delivery control is provided in a rotary piston compressor which takes the general form of a housing which is composed of a shell and two parallel side parts and has an outlet duct and at least one lateral inlet duct, and a piston which is mounted on an eccentric of an eccentric shaft, and which in rotation, defines with the inner surface of the shell, working chambers which are variable in volume and which with axial seals located along its circumferential edges, overrides one of the inlet ducts. The improvement of the delivery control device is provided by at least one recess in one side part lying in the direction of rotation of the piston after the inlet duct, a withdrawable plug being disposed within the recess so that it is flush in its closed position with the side wall. When the plug is withdrawn the recess enables one of the working chambers which is in the compression cycle to communicate with the inlet duct through a hollow space provided in the piston during sliding of the axial seals arranged along the circumference of the piston over the recess.

4 Claims, 3 Drawing Figures

DEVICE FOR DELIVERY CONTROL IN A ROTARY PISTON COMPRESSOR

BACKGROUND OF THE INVENTION

1. Field of the Invention

The invention relates to a device for delivery control arrangement in a rotary piston compressor of the form comprising a housing which is composed of a shell and two parallel side parts and has an outlet duct and at least one lateral inlet duct, and a piston which is mounted on an eccentric of an eccentric shaft, and which, in rotation, defines with the inner surface of the shell working chambers which are variable in volume and which, with its circumferential edges, or with axial seals located along its circumferential edges, overrides an inlet ducts which is located in at least one side part.

2. Description of the Prior Art

A device for delivery control in a rotary piston compressor is known e.g. by DE-OS No. 2539276, which is located in the side part of the housing and is composed of several axially running ducts which open in an annular chamber which is in communication with the inlet duct or with the atmosphere. The ducts are penetrated by a bore in which there is located a movable stop valve which runs parallel to the side wall. Depending upon the position of the stop valve, one or more ducts are opened to suit the conveyed quantity, so that the medium which is to be compressed can pass from the compression chamber through the annular space to the inlet duct or into the open air. When the stop valve is closed, there arises with this construction, however, the disadvantage that the ducts originating from the side wall form, between the working chamber and the stop valve, recesses which promote an undesirable overblowing into the adjacent working chamber and in which a residual volume remains which causes a loss of the delivered quantity and therefore a deterioration in efficiency.

SUMMARY OF THE INVENTION

It is an object of this invention to provide a device for delivery control which allows for operation of the compressor with a high degree of delivery, but which is simply and compactly constructed.

Accordingly, in the rotary piston compressor of the type hereinbefore defined, there is provided a device for delivery control wherein at least one side part defines at least one recess lying in the direction of rotation of the piston after the inlet duct, a withdrawable plug being disposed within the recess so that it is flush in its closed position with the side wall, such that, when the plug is withdrawn, the recess enables one of the working chambers which is in the compression cycle to communicate with the inlet duct through a hollow space provided in the piston during sliding of the edges of the circumference of the piston or the axial seals over the recess.

In this arrangement, the plug which seals flush in the closed position, forms part of the side wall, so that the recess neither makes overblowing into the adjacent working chamber possible nor forms a residual volume which impairs the degree of delivery and efficiency. When the plug is withdrawn, the medium sucked up, on the other hand, before it is compressed, can still flow directly through the recess thereby released and through the hollow space of the piston back into the area of the inlet duct almost free of pressure, so that the commencement of the compression can start considerably later. The delayed commencement of compression leads to a smaller quantity being conveyed and therefore to a correspondingly lower driving power. Moreover, as the flowing-back of the medium takes place inside the working chamber, in contrast to the known construction, no additional ducts encircling the working chamber, or an annular space, are necessary.

The device can be so constructed that the plug is located in a cylindrical bore disposed perpendicularly to the side wall and on the one hand can be brought into the withdrawn position which opens the recess, under the bias of a compression spring, and on the other hand, can be brought into the position which closes the recess, under the bias of a medium which is under pressure. In the case of this construction, the plug can only seal flush with the side wall if the medium used acts on the plug under pressure. A fluid or air which is fed to the cylindrical bore through a control member can be used as a medium.

With the use of air, the cylindrical bore can be connectable to the pressure side of the compressor. This means that the plug is withdrawn when the compressor is stationary and starting of the compressor can therefore be made considerably easier. Only during operation of the compressor can the plug be brought into the closed position by the air which is removed from the pressure side of the compressor. If a fluid is used for actuating the plug, lubricating oil, which can be diverted from the lubricating circuit of the compressor, can, for example, be used for this purpose. The medium which actuates the plug can obviously also be supplied from an external source, independently of the compressor.

In order to make delivery control over a larger area possible, several recesses can be located defined in one or both side parts one behind the other in the direction of rotation of the piston. A completely steady control can thereby be achieved.

BRIEF DESCRIPTION OF THE DRAWINGS

The invention may be performed in various ways and a preferred embodiment thereof will now be described with reference to the accompanying drawings, in which:-

DETAILED DESCRIPTION

Figure 1:
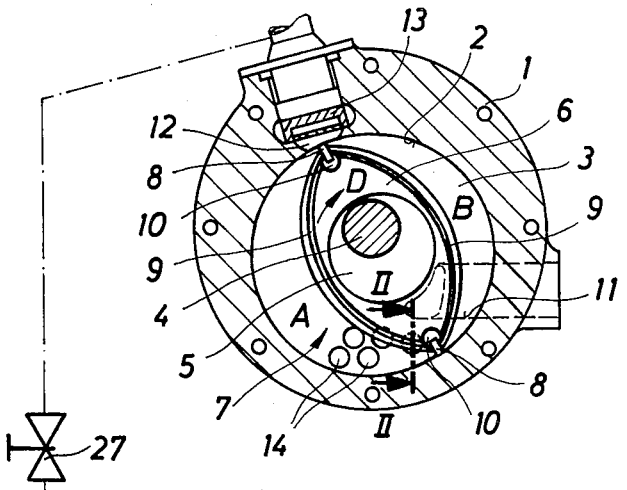
FIG. 1 shows a diagrammatic representation of a 1 to 2 ratio rotary piston compressor of trochoidal construction in cross-section.

The rotary piston compressor shown by way of example in FIG. 1 has a housing which is essentially composed of a shell 1 with a one-lobe inner surface area 2 and two parallel side parts 3 at either end of the shell 1. The housing is penetrated by an eccentric shaft 4, on whose eccentric 5 a double-pointed piston 6 is rotatably mounted. The piston 6 is provided with sealing elements which slide along the inner surfaces of the housing formed by the side walls 7 of the side parts 3 and the inner surface 2 of shell 1. The sealing elements of the piston 6 are composed not only of apex seals, 8, which are radially movably located in the corners of the piston 6, but also of sealing strips 9, which extend adjacent the circumferential edges of the piston 6 between the apex seals 8 and are connected to the latter by sealing bolts 10 to form a closed sealing grid. The sealing strips 9 and the sealing bolts 10 are arranged axially movably in each front wall of the piston 6 and are pressed flexibly against the side walls 7 of the side parts 3.

When the piston 6 rotates in the direction of the arrow D, the sealing elements constantly slide along the inner surfaces of the housing, whereby working chambers A and B which vary in volume are formed and sealed in relation to each other. To carry out the sealing operation, there are provided in at least one side part 3 and inlet duct 11, and in the shell 1 an outlet duct 12 with a pressure valve 13 of optional construction, where the inlet duct or ducts 11 are slid over and controlled by the sealing strips 9 which are located along the circumferential edges of the piston 6, and the outlet duct 12 is slid over and controlled by the apex seals 8 which are located in the corners of the piston. Each working chamber A and B, when the piston 6 rotates, performs in succession not only a suction cycle but also a compression and delivery cycle. Thus, with the piston 6 in the position which is shown in the drawing, the working chamber A is at the commencement of the compression cycle and the working chamber B is at the end of the delivery cycle and shortly before the commencement of the suction cycle.

In order to control the delivery of the rotary piston compressor, there are located in the side part 3 after the inlet duct 11 in the direction of rotation of the piston 6, recesses 14 which, like the inlet duct 11, are slid over by the axially movable sealing strips 9, which are located along the circumferential edges of the piston 6.

Figure 2:
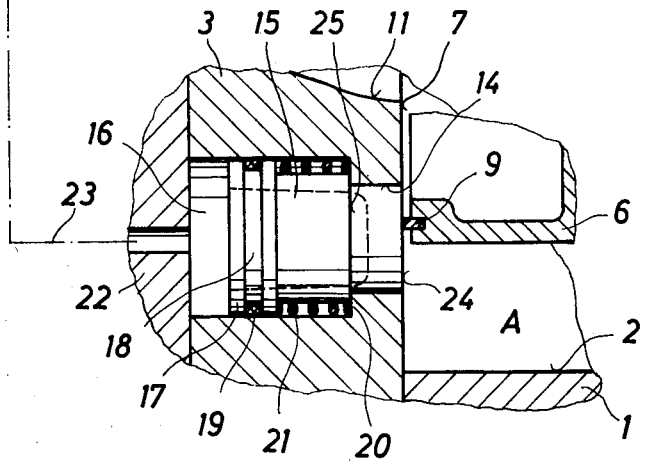
FIG. 2 is part of a longitudinal section on line II—II of FIG. 1 through a side wall illustrating a device for delivery control according to the invention.

As can be seen from FIG. 2, each recess 14 in the side part 3 can be closed by a plug 15, which is movably arranged, normally with respect to the side wall 7, in a cylinder bore 16 which connects with the recess 14. The plug 15 has, inside the cylindrical bore 16, a collar 17 which carries in an annular groove 18 a sealing ring 19 which cooperates sealingly with the cylindrical bore 16. On the one side of the collar 17—the right hand side in the drawing—there is supported, between the latter and an annular base area 20 of the cylindrical bore 16, a compression spring 21 which endeavours to withdraw the plug 15 away from the recess 14 and open the latter. On the other side of the collar 17 the cylindrical bore 16 is closed by a cover 22 through which leads a pipeline 23 which is connected to the outlet duct 12 or to the pressure side of the compressor. In the pipeline 23 there is located a control member 27 which is shown diagrammatically.

In the position shown, the plug 15 is actuated through the pipeline 23 by the medium which is under pressure and is conveyed by the compressor, when the control member 27 is opened, the pressure of which medium is higher than the elastic force of the compression spring 21, so that the plug 15 is pressed with its annular surface 25 against the base area 20 and with its front surface 24 sealing flush with the side wall 7. The front surface 24 of the plug 15 is therefore slid over by the sealing strips 9 located in the piston 6, just like the side wall 7, and the medium which is sucked into the working chamber A is therefore fully compressed.

Figure 3:
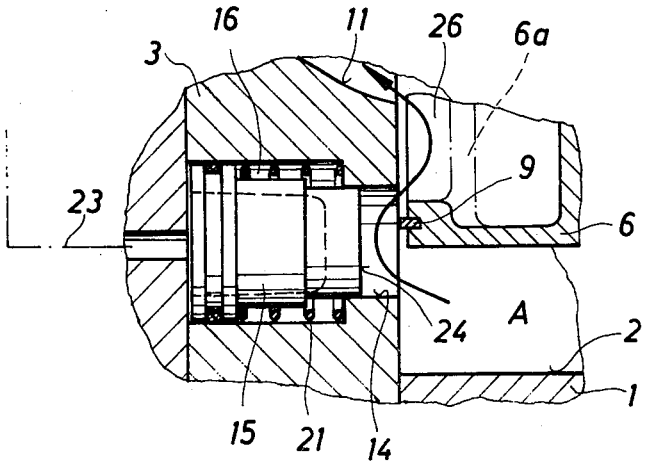
FIG. 3 is a section similar to that of FIG. 2 illustrating a device for delivery control whose position has been varied.

In FIG. 3, the actuation of the plug through the pipeline 23 has been interrupted by operating the control member 27, and the plug 15 is therefore pressed by the compression spring 21 into the withdrawn position. The recess 14 is thereby released, so that at least one part of the medium sucked into the working chamber, before it is compressed, can flow in the direction of the arrow indicated through the recess 14 and a hollow space 26 provided in the piston 6, back into the area of the inlet duct 11. A compression of the medium, which has been reduced by the quantity which has flowed back, commences only if the recess 14 has been slid over by the sealing strips 9. This position of the plug 15, which also occurs when the compressor is stationary, makes starting of the compressor easier, however, on account of the overblowing and later commencement of the compression. In the case of a piston which is provided with an inner chamber cooled with a fluid, the hollow space 26 through which the medium can flow back can merely extend as far as the side wall **6*a*** which is indicated in dot-dash lines.

When several recesses 14 are located in the side part 3, the actuation of the plugs 15 can be controlled in such a way that the closed positions thereof are obtained simultaneously or in succession. This makes a completely steady control possible.

What is claimed is:

1. A device for power control in a rotary piston compressor of the form comprising a housing which is composed of a jacket and two parallel side parts and has an outlet duct and at least one lateral inlet duct, and a piston which is mounted on an eccentric of an eccentric shaft, and which, in rotation, defines with the inner jacket area, working chambers which are variable in volume and which, with its circumferential edges, or with axial seals located along its circumferential edges, overrides one of the inlet ducts which is located in at least one side part, and wherein at least one side part defines at least one recess lying in the direction of rotation of the piston after the inlet duct, a withdrawable plug being disposed within the recess so that it is flush in its closed position with the side wall, such that, when the plug is withdrawn the recess enables one of the working chambers which is in the compression cycle to communicate with the inlet duct through a hollow space provided in the piston during sliding of the edges of the circumference of the piston or the axial seals over the recess.

2. A device for delivery control as claimed in claim 1, wherein the plug is located in a cylindrical bore disposed perpendicularly to the side wall and, on the one hand can be brought into the withdrawn position which opens the recess, under the bias of a compression spring, and on the other hand can be brought into the position which closes the recess, under the bias of a medium which is under pressure.

3. A device for delivery control as claimed in claim 2, wherein the cylindrical bore is arranged for connection to the pressure side of the compressor.

4. A device for delivery control as claimed in claim 1, wherein several recesses are defined one behind the other in at least one side part in the direction of rotation of the piston.

* * * * *

UNITED STATES PATENT AND TRADEMARK OFFICE

CERTIFICATE OF CORRECTION

PATENT NO. : 4,222,715

DATED : September 16, 1980

INVENTOR(S) : Max Ruf

It is certified that error appears in the above—identified patent and that said Letters Patent is hereby corrected as shown below:

Column 4, claim 1, line 28, "power" should be --delivery--;

line 30, "jacket" should be --shell--;

line 34, "jacket area" should be --surface of the shell--;

line 37, "one of the inlet ducts" should be --an inlet duct--.

Signed and Sealed this

*Eighth* Day of *February 1983*

[SEAL]

*Attest:*

GERALD J. MOSSINGHOFF

*Attesting Officer*

*Commissioner of Patents and Trademarks*